US012723532B2

(12) United States Patent
Box

(10) Patent No.: US 12,723,532 B2
(45) Date of Patent: Sep. 1, 2026

(54) EXHAUST HEAT CONDUCTOR PIPE SYSTEM FOR SCAVENGING WASTE HEAT

(71) Applicant: Charles Box, Lexington, KY (US)

(72) Inventor: Charles Box, Lexington, KY (US)

( * ) Notice: Subject to any disclaimer, the term of this patent is extended or adjusted under 35 U.S.C. 154(b) by 106 days.

(21) Appl. No.: 18/205,326

(22) Filed: Jun. 2, 2023

(65) Prior Publication Data

US 2024/0401513 A1 Dec. 5, 2024

(51) Int. Cl.
*F01N 5/02* (2006.01)
*F01N 13/14* (2010.01)

(52) U.S. Cl.
CPC ..... *F01N 5/02* (2013.01); *F01N 13/14* (2013.01); *F01N 2240/02* (2013.01); *F01N 2510/02* (2013.01)

(58) Field of Classification Search
CPC ..... F01N 5/02; F01N 13/14; F01N 2240/02; F01N 2510/02
USPC ..... 60/320; 165/156, 184
See application file for complete search history.

(56) References Cited

U.S. PATENT DOCUMENTS 6,151,891 A * 11/2000 Bennett ..... F28D 7/024 60/320
6,330,910 B1 * 12/2001 Bennett ..... F01N 5/02 237/12.3 A
6,730,274 B1 * 5/2004 Ideguchi ..... F01N 3/2046 422/177
7,063,134 B2 * 6/2006 Poole ..... F01N 5/02 165/135
7,227,274 B2 6/2007 Berkson
8,459,213 B2 6/2013 Moriarty et al.
8,522,537 B2 * 9/2013 Lee ..... F01M 5/001 60/320
8,978,745 B2 * 3/2015 Koo ..... F28D 7/024 165/177
9,567,941 B2 2/2017 Frank et al.
10,066,532 B2 9/2018 Yamashita et al.
2007/0158048 A1 * 7/2007 Ferraro ..... F28D 21/0007 165/47
2009/0038302 A1 * 2/2009 Yamada ..... F28D 7/1676 165/104.19
2012/0144814 A1 * 6/2012 Won ..... F01M 5/001 60/320
2012/0159951 A1 6/2012 Avery et al.
2018/0230874 A1 * 8/2018 Ghoniem ..... B01J 29/74

FOREIGN PATENT DOCUMENTS

CN 108868978 A * 11/2018 ..... F01N 5/02
CN 109630246 A * 4/2019
CN 115234400 A * 10/2022
DE 102009030866 A1 * 1/2011 ..... F01N 13/08
DE 202020106221 U1 * 12/2020
WO 2013036216 A1 3/2013

* cited by examiner

*Primary Examiner* — Patrick D Maines
(74) *Attorney, Agent, or Firm* — Stockwell & Smedley, PSC

(57) ABSTRACT

An exhaust heat conductor pipe system including a tube operatively associated with a pipe section for receiving heated combustion exhaust gas, the tube being in a helical configuration and including a plurality of lateral loops, wherein each lateral loop is in contact with at least one other lateral loop and the wall of the pipe section.

6 Claims, 6 Drawing Sheets

EXHAUST HEAT CONDUCTOR PIPE SYSTEM FOR SCAVENGING WASTE HEAT

BACKGROUND OF THE INVENTION

The invention relates generally to systems, devices and methods for using waste heat from a heat-generating application, such as a combustion engine, to generate steam for an associated steam-driven turbine, which can be further configured to produce electricity.

Waste heat generated by internal combustion engines is vented to the atmosphere by two primary means and one secondary means. The major primary means of heat venting is the very rapid venting of the hot exhaust gases into the atmosphere via the exhaust pipe. The other primary means of heat venting is via conduction and convection from the radiator in a liquid cooled engine, or from the cooling fins of an air-cooled engine. The secondary means is from conduction and convection from the engine itself along with its associated components.

While it is known in the field of power generation to provide one or more steam turbines in a plant with one or more combustion-type turbines and to use the waste heat contained in the exhaust of the combustion turbines to generate steam for the steam turbines, it is a challenge to duplicate such a configuration with respect to conventional internal combustion engines. For example, there is an inability to utilize a substantial percentage of the waste heat for steam or power production due to the very rapid egress of the hot exhaust gases through the exhaust system and out the exhaust pipe, as well as limited or other space concerns.

There is a need for improvement and solution to address the aforementioned issues that can make efficient use of the waste heat generated by a combustion engine, among other things.

SUMMARY OF THE INVENTION

The invention provides an internal combustion engine with a steam power generator that utilizes waste heat from combustion gases to generate steam under pressure to provide power which may be used to augment the power produced by the fuel burn of the engine. In some embodiments, the steam is generated by the conduction of heat from the exhaust pipe carrying heated combustion gases discharged by the internal combustion engine.

Some embodiments of the invention are directed to an exhaust heat conductor pipe system, comprising: a pipe section having a longitudinal tubular wall defining an inner pipe surface, an outer pipe surface and a hollow space enabling the flow of gas therein; a tube operatively associated with the pipe section, the tube being in a helical configuration and comprising an inlet, an outlet and a plurality of lateral loops between the inlet and the outlet, wherein each lateral loop of the plurality of lateral loops is (i) in contact with at least one other lateral loop of the plurality of lateral loops and (ii) in contact with the tubular wall; and an insulator layer in a radially outer position relative to the tube.

In some embodiments of the aforementioned system the plurality of lateral loops are in contact with the inner pipe surface.

In some embodiments of the aforementioned system the insulator layer is in contact with the outer pipe surface.

In some embodiments of the aforementioned system the plurality of lateral loops are in contact with the outer pipe surface.

In some embodiments of the aforementioned system the insulator layer is in contact with the tube.

Some embodiments of the invention are directed to an exhaust heat conductor pipe system, comprising: a pipe section having a longitudinal tubular wall defining an inner pipe surface, an outer pipe surface and a hollow space enabling the flow of gas therein; a tube operatively associated with the pipe section, the tube being in a helical configuration and comprising an inlet, an outlet and a plurality of lateral loops between the inlet and the outlet, wherein each lateral loop of the plurality of lateral loops is (i) in contact with at least one other lateral loop of the plurality of lateral loops and (ii) in contact with the inner pipe surface of the tubular wall; and an insulator layer in a radially outer position relative to the tube, the insulator layer being in contact with the outer pipe surface.

Some embodiments of the invention are directed to an exhaust heat conductor pipe system, comprising: a pipe section having a longitudinal tubular wall defining an inner pipe surface, an outer pipe surface and a hollow space enabling the flow of gas therein; a tube operatively associated with the pipe section, the tube being in a helical configuration and comprising an inlet, an outlet and a plurality of lateral loops between the inlet and the outlet, wherein each lateral loop of the plurality of lateral loops is (i) in contact with at least one other lateral loop of the plurality of lateral loops and (ii) in contact with the outer pipe surface of the tubular wall; and an insulator layer in a radially outer position relative to the tube, the insulator layer being in contact with the plurality of lateral loops.

Other embodiments, features and advantages of the invention will be readily appreciated and apparent from the following detailed description when considered in connection with the accompanying drawings.

BRIEF DESCRIPTION OF THE DRAWINGS

Various advantages of the invention will be readily appreciated as the same becomes better understood by reference to the following detailed description when considered in connection with the accompanying drawings. The components in the figures are not necessarily to scale, emphasis instead being placed upon illustrating the principles of the invention.

DETAILED DESCRIPTION OF THE INVENTION

Figure 1:
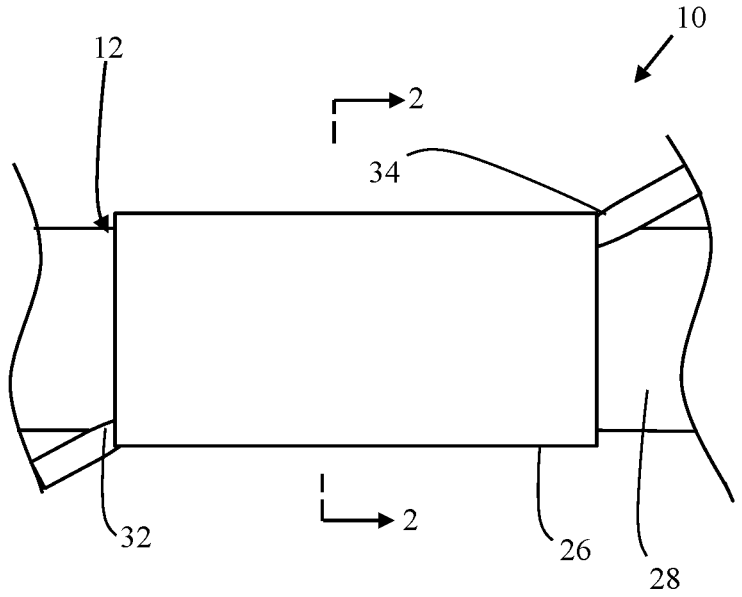
FIG. 1 is a schematic view of an exhaust heat conductor pipe constructed in accordance with an embodiment of the invention.

The following detailed description provides exemplary embodiments of systems, devices and methods for enabling efficient use of heat generated by a combustion engine or other process which generates a heated exhaust stream to provide for heat transfer into a conduit carrying a fluid stream sufficient to cause a phase change from liquid to a pressurized gaseous state which may then be used for driving a turbine to produce electricity, and then allowing the return to a liquid state for recycling through the conduit to undergo the process again.

Various embodiments are illustrated in the drawings wherein like characters indicate like parts throughout the several views. However, it will be readily understood from the description of the embodiments of the invention herein, and the elements thereof, could be alternatively configured within the scope of the invention. This description is therefore intended to generally describe and illustrate examples of the invention, but is not intended to limit the scope of the invention to the examples, embodiments and elements described herein.

Figure 2:
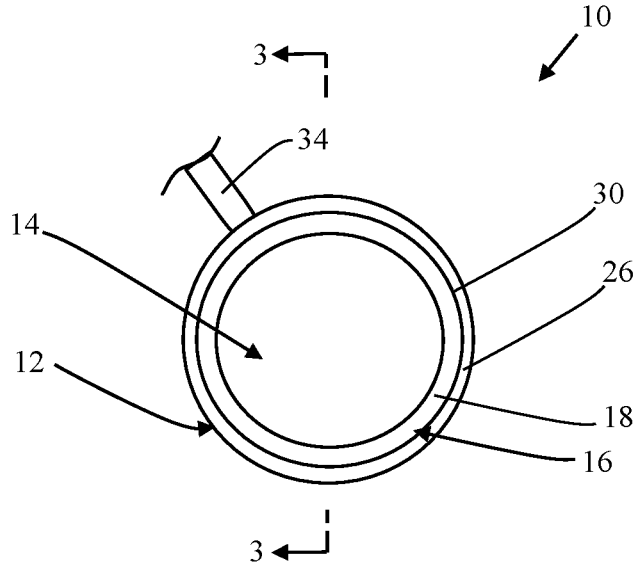
FIG. 2 is a cross-sectional view of the embodiment of the invention shown in FIG. 1 taken along line 2-2 of FIG. 1.
Figure 3:
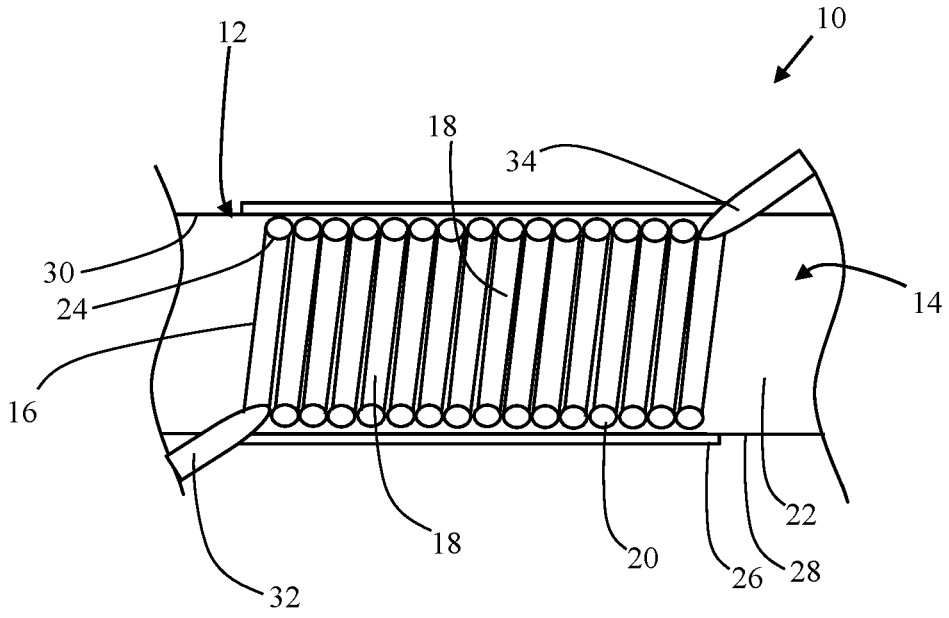
FIG. 3 is a cross-sectional view of the embodiment of the invention shown in FIG. 1 taken along line 3-3 of FIG. 2.

Referring to FIGS. 1-3, an exhaust heat conductor pipe constructed in accordance with the invention is generally designated by the reference numeral 10. In this embodiment, exhaust heat conductor pipe 10 is formed in a pipe section 12 of a longitudinal exhaust pipe defining a space 14 through which a heated fluid flows, such as the exhaust gas from a combustion engine.

A tube 16 is positioned within space 14 and wrapped in a helical fashion forming a coil of lateral loops 18, with each lateral loop 18 abutting an adjacent (either one or two) lateral loop 18. Each lateral loop 18 has an outer surface wall 20 abutting inner circular surface 22 of wall 30 of pipe section 12 and an inner surface wall 24 exposed to space 14.

Tube 16 generally extends along a longitudinal length within pipe section 12 with each lateral loop 18 winding latitudinally along inner surface 22 of wall 30. In this embodiment, tube 16 is depicted as a single tube coiled in a helical fashion, whereas in other embodiments, tube 16 may comprise two or more coiled tubes wrapped together in a helix within pipe section 12.

It should be understood that the terms "pipe" or "tube" as used herein represent any stationary tube, pipe, conduit or channel, of any material that can be used to transport fluids, whether gas or liquid. The invention is not limited to pipes or tubes of any shape, such as cylindrical in shape, as tubes or pipes of any cross-section may be used. The pipes or tubes, such as tube 16, may be formed of a variety of materials, particularly materials which are durable, resistant to corrosion and are capable of heat transfer, such as metals.

In this embodiment, an insulator 26 is wrapped as a layer around the periphery or outer surface 28 of wall 30 of pipe section 12 in a radially outer position adjacent to the position of tube 16 within pipe section 12. Tube 16 further includes an inlet 32 extending through wall 30 of pipe section 12 and an outlet 34 extending through wall 30 of pipe section 12. In some embodiments, an insulation layer, such as insulator 26, is not included.

Figure 4:
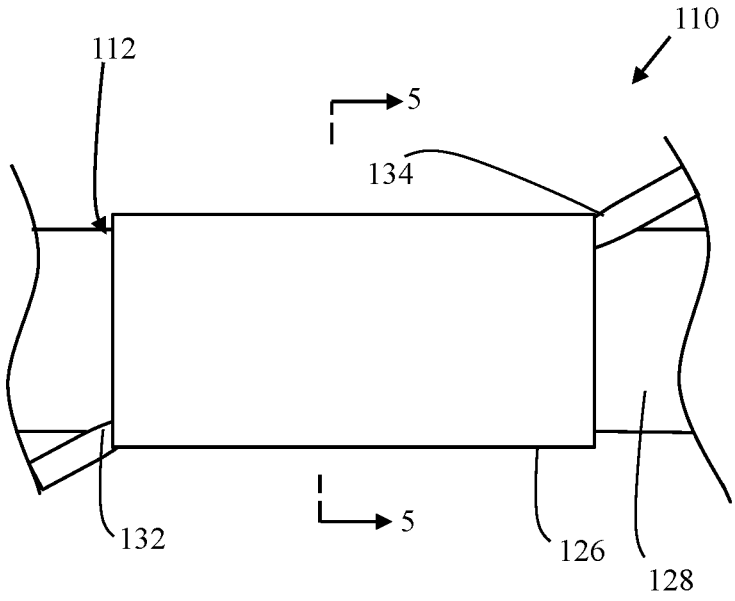
FIG. 4 is a schematic view of an exhaust heat conductor pipe constructed in accordance with another embodiment of the invention.
Figure 5:
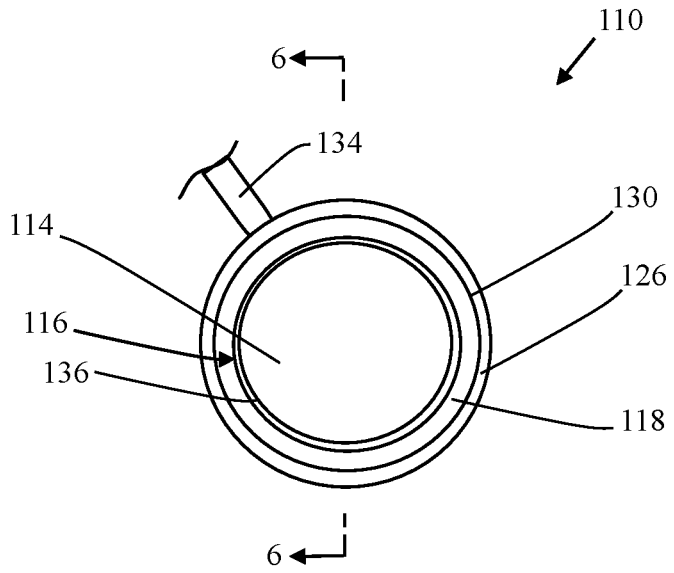
FIG. 5 is a cross-sectional view of the embodiment of the invention shown in FIG. 4 taken along line 5-5 of FIG. 4.
Figure 6:
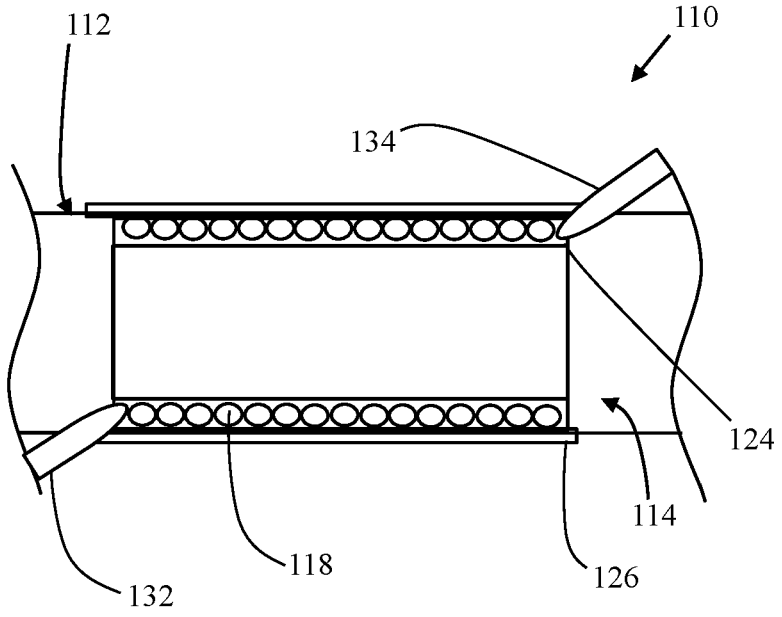
FIG. 6 is a cross-sectional view of the embodiment of the invention shown in FIG. 4 taken along line 6-6 of FIG. 5.

FIGS. 4-6 illustrate another embodiment of an exhaust heat conductor pipe 110 constructed in accordance with the invention in which tube 116 is separate or shielded from space 14 within pipe section 12. Tube 116 including loops 118, are positioned between layer 136, which is radially inner, and wall 30, which is radially outer, as compared with tube 116. Layer 136 may be constructed of a corrosion resistant material capable of heat transfer, such as a metal.

Figure 7:
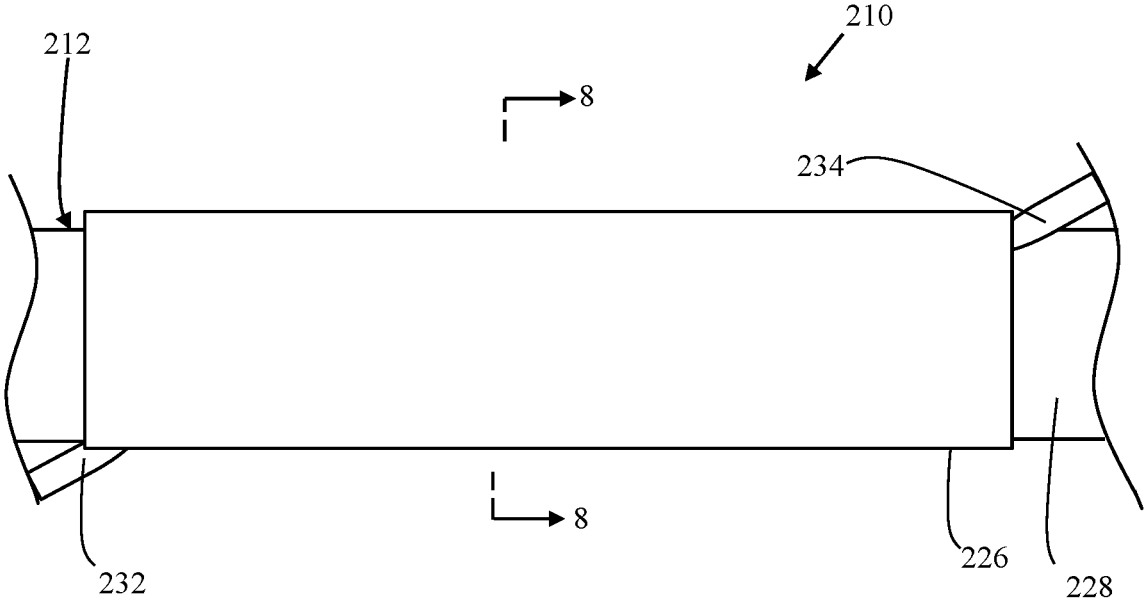
FIG. 7 is a schematic view of an exhaust heat conductor pipe constructed in accordance with yet another embodiment of the invention.
Figure 8:
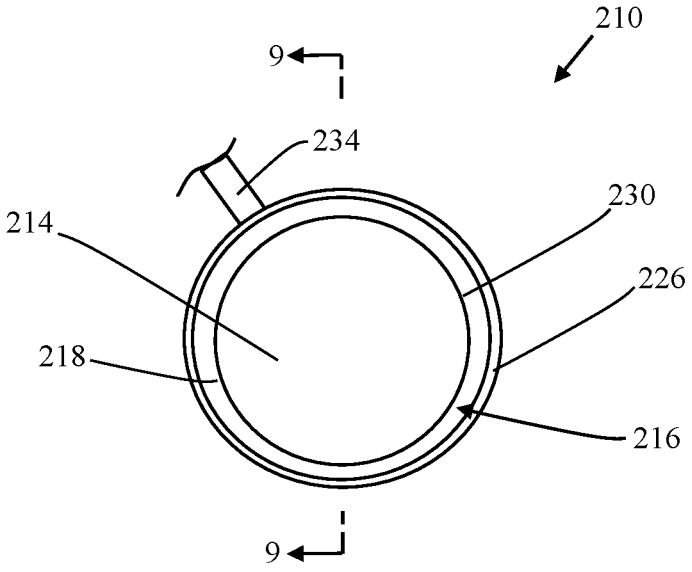
FIG. 8 is a cross-sectional view of the embodiment of the invention shown in FIG. 7 taken along line 8-8 of FIG. 7.
Figure 9:
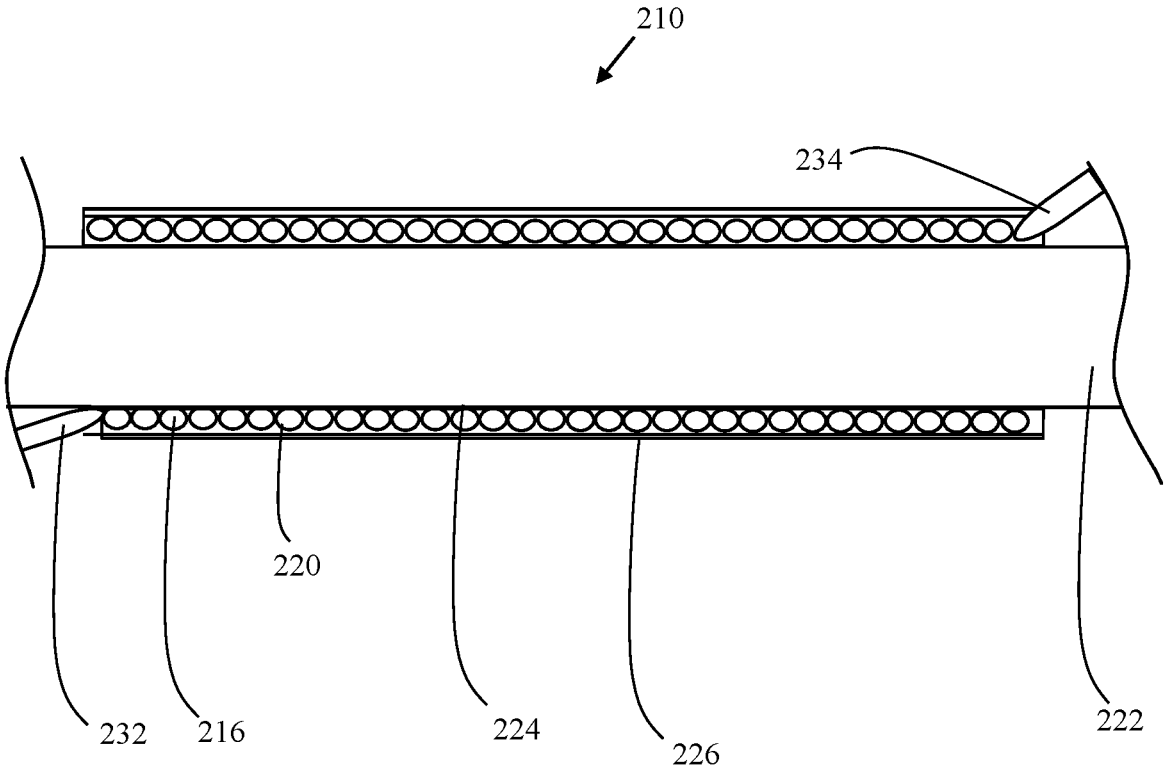
FIG. 9 is a cross-sectional view of the embodiment of the invention shown in FIG. 4 taken along line 9-9 of FIG. 8.

FIGS. 7-9 illustrate another embodiment of an exhaust heat conductor pipe 210 in which tube 216 is outside of pipe section 112. Tube 216 is coiled along a longitudinal length of pipe section 212 with each lateral loop 218 having an inner surface wall 224 abutting outer surface 228 of wall 230. An insulator 226 is wrapped about tube 216 at a radially outer position abutting outer surface wall 220 of tube 216.

Figure 10:
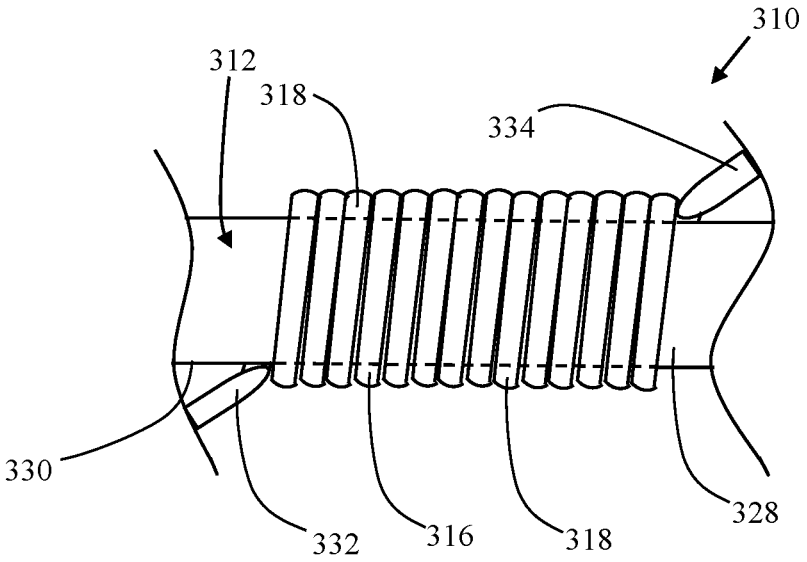
FIG. 10 is a schematic view of an exhaust heat conductor pipe constructed in accordance with yet another embodiment of the invention, illustrating, among other things, an exemplary helical configuration of a fluid tube part of the exhaust heat conductor pipe constructed in accordance with the invention.

FIG. 10 illustrates an embodiment of an exhaust heat conductor pipe 310 illustrating the helical configuration of pipe 316 with each lateral loop 318 being coiled along a longitudinal length of pipe section 312 abutting outer surface 328 of pipe wall 330.

Figure 11:
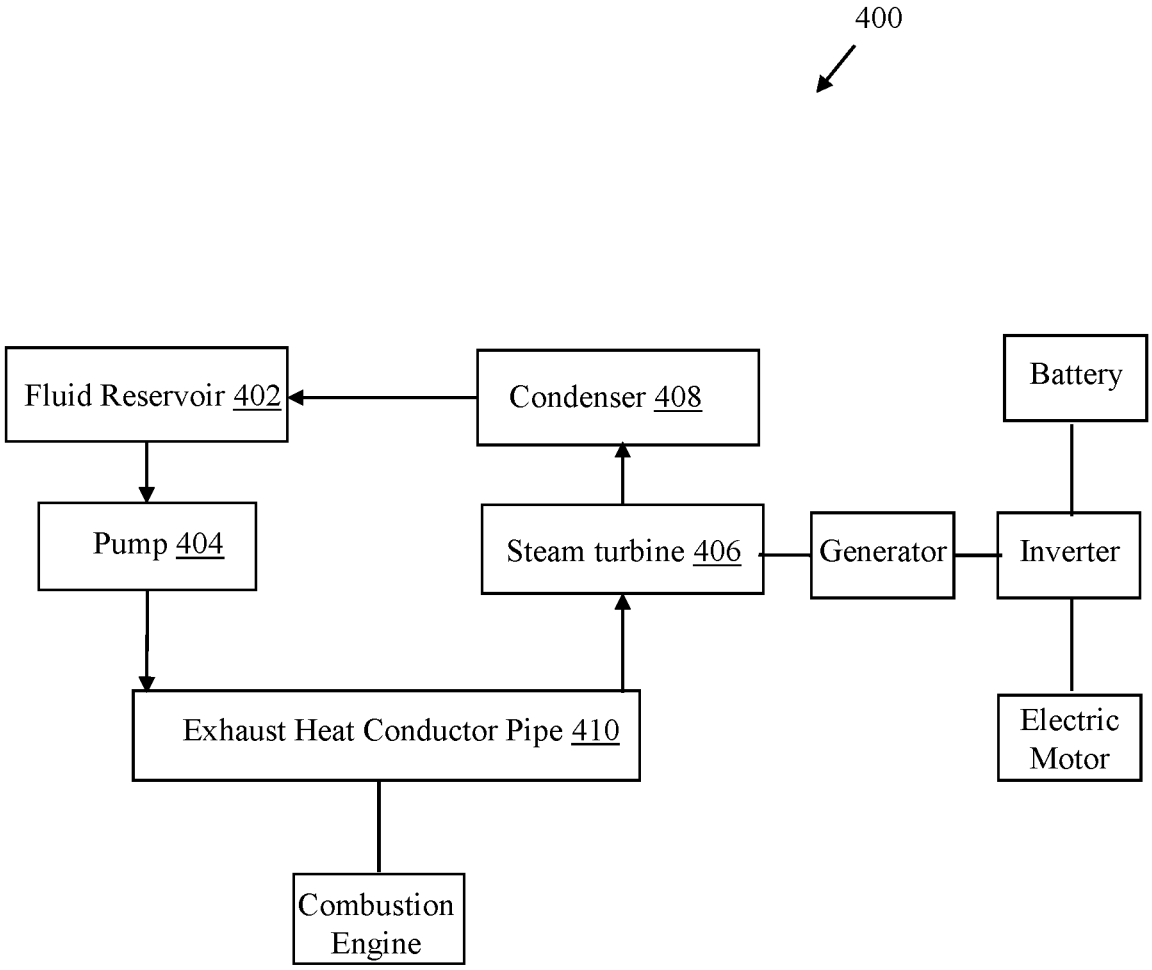
FIG. 11 is a schematic diagram of components of an exemplary system of the invention incorporating an exhaust heat conductor pipe constructed in accordance with an embodiment of the invention.

FIG. 11 illustrates a system 400 incorporating an exhaust heat conductor pipe 410 constructed according to the invention, including but not limited to the embodiments shown herein in FIGS. 1-10.

A combustion engine generates heated combustion gases which is vented either directly to exhaust heat conductor pipe 410 or through an exhaust pipe in communication with exhaust heat conductor pipe 410. A fluid in liquid form is provided from a fluid reservoir 402 via pump 404 to a helical coil tube associated with heat conductor pipe 410, such as tube 16, 116, 216 or 316. The fluid is heated by the heated combustion gases passing through exhaust heat conductor pipe 410 via conduction, undergoing a phase change to gaseous form, such as steam. The gas is then directed under pressure from pump 404 or a second pump to a steam turbine 406. The steam turbine 406 may be effectively connected to augment the power supplied by the internal combustion engine or to act as a power transfer medium. For example, steam turbine 406 may be connected with a generator, inverter and electric motor and/or rechargeable battery, which are shown in FIG. 11 for illustrative purposes.

In some embodiments, the exhaust heat conductor pipe of the invention is incorporated in a modified exhaust manifold which further includes one-way valves and water injection ports to enable steam pressurization within the manifold.

Steam spent in turbine 406 is condensed in condenser 408 and returned as a liquid to fluid reservoir 402 with exhaust gases being vented to atmosphere subsequent to the utilization of the previously wasted heat energy for power production.

While exemplary devices, apparatus, systems and methods of the invention have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth by the claims and any equivalents thereto.

The invention claimed is:

1. An exhaust heat conductor pipe system, comprising:

a) an exhaust pipe section configured to convey exhaust gas, the exhaust pipe section including a longitudinal tubular wall defining an inner pipe surface, a space for the flow of exhaust gas and an outer pipe surface;

b) a helical tube operatively associated with the exhaust pipe section, the helical tube including an inlet, an outlet, and a plurality of lateral loops formed in the exhaust pipe section so as to wind helically between the inlet and the outlet, each lateral loop including: (i) a first portion being in contact with at least one adjacent lateral loop of the plurality of lateral loops, and (ii) a second portion being in contact with the inner pipe surface of the longitudinal tubular wall; and c) an insulator layer in a radially outer position relative to the helical tube; and d) a shield layer disposed between the helical tube and the space for the flow of exhaust gas.

2. The exhaust heat conductor pipe system of claim 1, wherein each lateral loop further comprises a third portion in contact with the shield layer.

3. The exhaust heat conductor pipe system of claim 2, wherein the insulator layer is in contact with the longitudinal tubular wall along the outer pipe surface.

4. An exhaust heat conductor pipe system, comprising:

a) an exhaust a pipe section configured to convey exhaust gas, the exhaust gas pipe section including a longitudinal tubular wall defining an inner pipe surface, a space for the flow of exhaust gas and an outer pipe surface;

b) a helical tube operatively associated with the exhaust pipe section, the helical tube including an inlet, an outlet, and a plurality of lateral loops formed in the exhaust pipe section so as to wind helically between the inlet and the outlet, each lateral loop being in contact with: (i) at least one adjacent lateral loop of the plurality of lateral loops, and (ii) the inner pipe surface of the longitudinal tubular wall;

c) an insulator layer in a radially outer position relative to the helical tube, the insulator layer being in contact with the outer pipe surface of the longitudinal tubular wall; and d) a shield layer disposed between the helical tube and the space for the flow of exhaust gas, wherein the shield layer comprises a corrosion-resistant material capable of heat transfer.

5. The exhaust heat conductor pipe system of claim 4, wherein each lateral loop further comprises a portion in contact with the shield layer.

6. An exhaust heat conductor pipe system, comprising:

a) an exhaust pipe section configured to convey exhaust gas, the exhaust gas pipe section including a longitudinal tubular wall defining an inner pipe surface, a space for the flow of exhaust gas and an outer pipe surface;

b) a helical tube operatively associated with the exhaust pipe section, the helical tube including an inlet, an outlet, and a plurality of lateral loops formed in the exhaust pipe section so as to wind helically between the inlet and the outlet, each lateral loop including: (i) a first portion being in contact with at least one adjacent lateral loop of the plurality of lateral loops; and (ii) a second portion being in contact with the inner pipe surface of the longitudinal tubular wall;

c) an insulator layer in a radially outer position relative to the helical tube, the insulator layer being in contact with the outer pipe surface of the longitudinal tubular wall; and d) a shield layer disposed between the helical tube and the space for the flow of exhaust gas, wherein each lateral loop includes a third portion in contact with the shield layer.

* * * * *